US012221753B2

(12) United States Patent
Grünwald

(10) Patent No.: US 12,221,753 B2
(45) Date of Patent: Feb. 11, 2025

(54) INDIRECT ASPHALT HEATING SYSTEM

(71) Applicant: Komline-Sanderson Corporation, Peapack, NJ (US)

(72) Inventor: Douglas W. Grünwald, Andover, NJ (US)

(73) Assignee: Komline-Sanderson Corporation, Peapack, NJ (US)

( * ) Notice: Subject to any disclaimer, the term of this patent is extended or adjusted under 35 U.S.C. 154(b) by 583 days.

(21) Appl. No.: 17/464,071

(22) Filed: Sep. 1, 2021

(65) Prior Publication Data

US 2023/0068159 A1 Mar. 2, 2023

(51) Int. Cl.
*E01C 19/08* (2006.01)

(52) U.S. Cl.
CPC ..... *E01C 19/08* (2013.01)

(58) Field of Classification Search
CPC .. E01C 19/08; E01C 19/1004; E01C 19/1063; E01C 19/1045
See application file for complete search history.

(56) References Cited

U.S. PATENT DOCUMENTS 6,012,870 A * 1/2000 Dillingham ..... E01C 19/08 404/101
7,179,018 B2 * 2/2007 Hall ..... E01C 23/06 404/90
9,719,214 B1 * 8/2017 Greene ..... C10C 3/12
2009/0300937 A1 * 12/2009 Gruenwald ..... C02F 11/13
2020/0123714 A1 * 4/2020 Dillingham ..... E01C 11/005
2020/0149811 A1 * 5/2020 Grunwald ..... F26B 25/08

FOREIGN PATENT DOCUMENTS

CA 2357037 Y * 1/2000
JP 2019126788 A * 8/2019
KR 200418588 Y1 * 3/2006 ..... E01C 19/08
KR 100843766 B1 * 7/2008 ..... E01C 19/08

* cited by examiner

*Primary Examiner* — Ko-Wei Lin

(74) *Attorney, Agent, or Firm* — Buckley, Maschoff & Talwalkar LLC

(57) ABSTRACT

Provided is an indirect paddle heater and method for heating asphalt. In one example, the paddle heater may include a control system, a pump to pump heating fluid, a trough that may include an inlet to receive a feed of asphalt mixture and an outlet for exiting the asphalt mixture after heating, and one or more rotational agitators disposed in the trough and comprising paddles attached to shafts that rotate to move the asphalt mixture from the inlet to the outlet, wherein at least one of the trough and the one or more rotational agitators may include hollow channels, and the control system is configured to control the pump to pump heating fluid into the hollow channels when the asphalt mixture is included within the trough.

13 Claims, 5 Drawing Sheets

INDIRECT ASPHALT HEATING SYSTEM

BACKGROUND

Rotary drum heaters are often used to heat asphalt pavement for pouring into roads, sidewalks, driveways, and the like. This process usually begins with virgin aggregate being fed into an inlet of the rotary drum heater where the virgin aggregate is heated and dried using combustion heat (created by burning of natural gas, fuel oil, or other fuels). The heated gas applied directly to the aggregate can be at temperatures as high as 2500° F. When the aggregate has reached a desired temperature, reclaimed asphalt pavement (RAP) can be added to the heated mass along with bitumen often somewhere towards the end of the rotary drum heater. However, if the gas temperature is too high (e.g., 600° F.), the bitumen will oxidize and generate what is known in the industry as "blue smoke." Therefore, the plant operator must wait to add the RAP/bitumen until the virgin aggregate has heated and the gases have sufficiently cooled (e.g., 400° F.) before adding the RAP.

Because of these issues, only about one half of the total amount of the heated asphalt mixture can be RAP. In other words, at least 50% of the asphalt mixture must be virgin aggregate. If too much RAP were added to the mixture, there would not be enough heat left from the heated aggregate to sufficiently heat the RAP. Furthermore, adding additional combustion gas to the asphalt mixture which includes RAP and bitumen would cause the bitumen to burn. Accordingly, what is needed is a drum heater capable of heating RAP without a need for high temperature combustion gases.

SUMMARY

The example embodiments are directed to a paddle heater (also referred to as a paddle processor) for heating asphalt without the need for combustion gases. The paddle heater includes a trough (holding chamber) and one or more rotating agitators that contact/agitate the asphalt held in the trough. At least one of the trough and the agitators (e.g., paddles, shafts, etc.) are implemented with hollow channels that can carry heating fluid enabling at least one of the trough and the agitators to apply indirect heat to the asphalt mixture. For example, the heating fluid may be pumped through the hollow channels raising a temperature of the trough and/or the agitators to approximately 400-500° F. which is significantly below the heated gases created by combustion. Furthermore, because of this indirect heat, RAP (and bitumen) can be added at the beginning of the heating process rather than later on as is the case in conventional rotary drum asphalt heaters. This enables the asphalt mixture to be 100% RAP without any virgin aggregate being necessary.

According to an aspect of an example embodiment, provided is an asphalt heating system that may include one or more of 1) a thermal fluid heater, 2) a thermal fluid pump to pump the heating fluid, 3) a trough comprising an inlet or multiple inlets to receive virgin aggregate, RAP, asphalt cement, and or other ingredients used to make HMA (hot mix asphalt), 4) an outlet for exiting the asphalt mixture after heating, 5) one or more rotational agitators disposed in the trough and comprising of heating and or mixing paddles to heat, mix, and or move the asphalt mixture from the inlet to the outlet, wherein at least one of the trough and the one or more rotational agitators comprise hollow channels, and a 6) control system which is configured to control the temperature of the heating fluid pumped into the hollow channels when the asphalt mixture is included within the trough.

According to an aspect of another example embodiment, provided is a method of indirectly heating asphalt that may include two or more rotating agitators comprising of paddles that intermesh with the paddles on the neighboring shaft and housed within a trough of an asphalt heating system, feeding an asphalt mixture into an inlet of the trough where the two or more agitators are rotating causing the asphalt mixture to move towards an outlet of the trough, and transferring indirect heat to the asphalt mixture via at least one of the trough and the one or more agitators to heat the asphalt mixture while it is within the trough.

Other features and aspects may be apparent from the following detailed description taken in conjunction with the drawings and the claims.

BRIEF DESCRIPTION OF THE DRAWINGS

Features and advantages of the example embodiments, and the manner in which the same are accomplished, will become more readily apparent with reference to the following detailed description taken in conjunction with the accompanying drawings.

Figure 1:
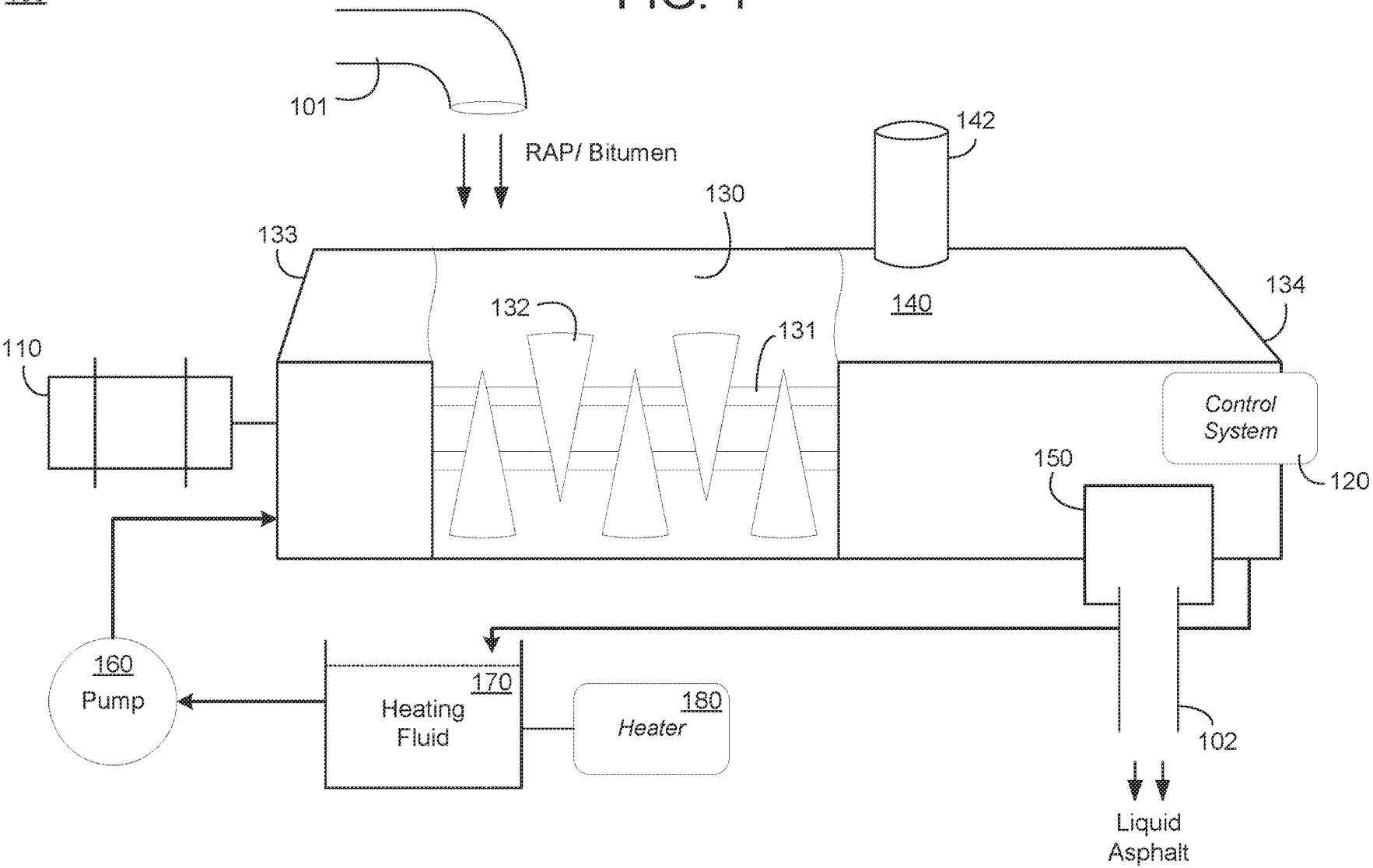
FIG. 1 is a diagram illustrating an overview diagram of a paddle heater in accordance with an example embodiment.

Throughout the drawings and the detailed description, unless otherwise described, the same drawing reference numerals will be understood to refer to the same elements, features, and structures. The relative size and depiction of these elements may be exaggerated or adjusted for clarity, illustration, and/or convenience.

DETAILED DESCRIPTION

In the following description, details are set forth to provide a thorough understanding of various example embodiments. It should be appreciated that modifications to the embodiments will be readily apparent to those skilled in the art, and generic principles defined herein may be applied to other embodiments and applications without departing from the spirit and scope of the disclosure. Moreover, in the following description, numerous details are set forth as an explanation. However, one of ordinary skill in the art should understand that embodiments may be practiced without the use of these specific details. In other instances, well-known structures and processes are not shown or described so as not to obscure the description with unnecessary detail. Thus, the present disclosure is not intended to be limited to the embodiments shown, but is to be accorded the widest scope consistent with the principles and features herein.

A paddle heater is a machine that transfers heat to a mass of material (e.g., asphalt mixture) as it is held within a trough thereof. Agitators may be nestled within the trough and may rotate causing the asphalt to be agitated and conveyed slowly from one end of the trough to the other. Each agitator may include a cylindrical shaft with paddles sticking out thereof. In some embodiments, the paddles may be wedged shaped. In other embodiments the paddles sides may be parallel and more streamlined. In some embodiments, a paddle heater may be implemented with two agitators or more, but embodiments are not limited thereto. The rotating paddles of the agitators may intermesh with one another to mix and move the material within the trough. In some cases, the paddles and are spaced far enough apart from each other to reduce friction.

In a traditional rotary drum heater, a combustion heat source is disposed at an inlet of a heating chamber. The inlet receives virgin aggregate which is then heated by the combustion gases which can be up to 2500° F. When the aggregate has reached a desired temperature (e.g., 300-400° F.), reclaimed asphalt pavement (RAP) can be added to the heated mass along with bitumen. In this conventional system, the RAP is added to a middle/center of the heating chamber or at an opposing end of the heating chamber (e.g., an outlet) to prevent the bitumen from burning and producing blue smoke.

The example embodiments overcome the drawbacks in the art through the introduction of a paddle heater (asphalt heating system) which uses indirect heat to heat the asphalt mixture rather than combustion gas. Indirect heat is much easier to control than combustion gas and can be supplied at a much lower temperature. For example, the indirect heat can be controlled so that the asphalt mixture is never contacted with a heat source above a predetermined temperature (e.g., 400° F. to 500° F., etc.) In doing so, the example embodiments provide a paddle heater capable of heating entirely RAP (reclaimed asphalt pavement) without the need for virgin aggregate. Thus, the example embodiments provide an asphalt heating system capable of using entirely recycled pavement to create asphalt for pouring streets, sidewalks, driveways, parking lots, etc.

The indirect heat may be transferred to the asphalt mixture by pumping heating fluid through various components of the paddle heater. As an example, the trough where the asphalt mixture is held may be a jacketed trough with hollow channels, cavities, etc. disposed between an exterior of the trough (in contact with the outside world) and an interior of the trough (in contact with the asphalt mixture). As another example, the shaft and/or the paddles of the agitators may include hollow channels, cavities, etc., disposed underneath an exterior surface of the shaft and/or the paddles which contact the asphalt mixture in the trough.

The heating fluid can be pumped through hollow channels of one or more of the trough, the shaft, the paddles, etc., to create the indirect heat source. When the asphalt mixture contacts the interior surface of the trough and/or the exterior surface of the shaft/paddles, the asphalt mixture heats up. Furthermore, the trough may be configured with one or more temperature sensors that can detect the current temperature of the asphalt mixture, which can be fed to a control system. Based on the temperature reading, the control system can increase/decrease a temperature of the indirect heat by reducing or increasing the amount of heating fluid flowing therethrough, by reducing or increasing a temperature of the heating fluid flowing therethrough, and the like.

In combustion-based rotary drum heaters, the amount of RAP as a percentage of the total asphalt mixture is limited. RAP cannot typically be added at the beginning of a heating operation of asphalt by the rotary drum heater. That is because bitumen starts to burn at 600° F. while the initial combustion gases can be significantly higher. Therefore, the hot gas is used to heat and dry the virgin aggregate first. Virgin aggregate has no problem being heated with the hot gas. As the aggregate heats up, the gases cool. Once the gases have sufficiently cooled to a temperature that will not damage the bitumen, the RAP is added usually in the middle or towards the end of a trough of the rotary drum heater.

Furthermore, the most amount of RAP that can be added is about 50% RAP. If additional RAP were added when the gases are at the right temperature, there is not enough heat left over to sufficiently heat the material. Furthermore, if RAP is added earlier in the process and the gases have not sufficiently cooled, the lower boiling point hydrocarbons in the bitumen will start to volatilize. When it does, it creates what is called "blue smoke".

The residence time in rotary drum heaters can be short (e.g. 4 to 8 minutes) and sometimes will not uniformly heat the product. Sometimes, the outside of large particles can become hot while the inside of the particle has not yet reached the desired temperature and is "cool". If the inside of the product is not heated, the product will cool down faster and effect product quality and flowability at the job site. In contrast, the residence time in a paddle heater is much longer, providing uniform heating of the mix asphalt, In a rotary dryer, large amount of air flow can entrain the fines, resulting in a loss of material and requiring large bag houses. This large air flow does not exist in the paddle heater eliminating the loss of material and requiring a much smaller off-gas handling system.

Aggregate alone is extremely abrasive and wear problems are significant when the material is "dry". By adding the RAP and or bitumen with or before the aggregate, the melted bitumen acts like a lubricant to reduce wear.

Furthermore, the paddle heater that is described herein can receive 100% RAP fed thereto without any virgin aggregate. Natural gas or other fuel or electricity can be used in a thermal fluid heater to heat a non-toxic mineral oil (thermal fluid) to a temperature of 400° F.-500° F. while keeping the material temperature below 350° F. This is below the temperature where bitumen burns. The thermal fluid is then pumped by a centrifugal pump to hollow channels/cavities of the paddle heater such as channels in the trough and/or channels in the agitators. For example, the paddle heater may have a jacketed trough and the thermal fluids heats the material inside. As another example, the paddle heater may have one or more (e.g., two, etc.) counter rotating agitators to help mix and convey the material. The agitators (e.g., the shafts, paddles, etc.) may be hollow and thermal fluid is pumped into the shafts through rotary joints to provide additional heating. To further increase the amount of heating, hollow paddles may be welded to the agitator shafts. Inside the agitator shaft, internal flow pipes are used to direct the thermal fluid in and out of these paddles creating very effective and efficient heat transfer surfaces. This triples the amount of heating area. The heated paddles, shafts, and jacket are used to heat the RAP to a desired temperature (e.g., 310° F., etc.)

Some of the benefits of the example embodiments is that the paddle heater uses indirect heat rather than direct heat. Thermal fluid at 400 to 500° F. is used to heat the heater and not combustion gases at temperature of 2,500° F. This permits the heating of 100% RAP to be fed into the heater without overheating the RAP and generating blue smoke. One of the unique points of this process is that the RAP or the bitumen can be added first. Meanwhile, the aggregate can then come second thus reducing the abrasiveness of the process. This is the exact opposite of what is traditionally done. In fact, this can't be done by the traditional process which makes this method unique.

As another example, if desired, RAP, virgin aggregate (if needed) and additional bitumen (again, if needed) can be fed together into the paddle heater at the same time and not at different times as is the case of a combustion-based rotary drum heater. This means one feed device, not three. The paddle heater actively mixes the asphalt mixture to provide uniform heating and a homogeneous product. Furthermore, if desired, 100% RAP can be fed to the paddle heater, and the need for virgin aggregate may be eliminated. In this case, bitumen can be added at the beginning of the heating process so that damage to the paddles/agitators can be prevented at the beginning. Furthermore, by not using a large amount of air, the need for a large bag house is eliminated. The thermal fluid may be pumped into the paddle heater at 500° F. and leave the paddle heater around 420° F. This provides more uniform heating temperatures than gas that starts at 2,500° F. and leaves the rotary kiln at 500° F.

To protect the paddle heater from abrasion, the entire trough may be hard surfaced with a weld applied hard surfacing (e.g., a chromium carbide alloy, etc.) All the leading edges, crowns, and sides of the paddles may also be hard surfaced. The paddle heater may have wedge shaped paddles that intermesh to promote agitation. However, with increased agitation there is increase wear. To reduce the wear on the paddles, the shafts center distance may be increased so the paddles no longer intermesh. This reduces the shearing forces that are associated with the intermeshing wedge shaped paddles.

During an initial heating process, the feed material may be introduced over a predetermined distance of the trough (and the agitators) such as the first 30% to 40% of the trough. Testing has demonstrated that when "dry aggregate" is processed (that is aggregate with no bitumen or with bitumen but is cold), it is extremely abrasive and will wear away even the hard surfacing material after a few hours. Dry aggregate resists flow and is not easily mixed. To overcome this resistance to flow, significant forces must be applied to move the material. These forces translate into frictional forces which are abrasive. By spreading the incoming feed over the first third of the dryer, the bed temperature where the material is introduced is higher. This gives the bitumen a chance to soften and melt.

FIG. 1 illustrates an overview of a paddle heater 100 (paddle processor) in accordance with an example embodiment. For example, the paddle heater 100 may be used to heat/dry a material such as asphalt. In this example, an exterior 140 of the paddle heater 100 is shown with a cutaway view of an interior of a trough 130 which makes a large portion of the body of the paddle heater 100. Inside the trough 130 is a plurality of agitators which each include a shaft 131 and paddles 132 attached thereto which rotate with the shaft 131 and around the shaft 131 (e.g., as an axis) as the shaft 131 rotates. Here, the paddles 132 may be arranged on dual shafts 131 where paddles on the first shaft interlock or intermesh with paddles on the second shaft as the paddles/shafts rotate For example, the paddles 132 may be arranged in a WW configuration where the paddles do not intermesh at all, but they are not limited thereto. The interlocking shape may be used to create an optimal contact surface to transfer heat to the asphalt. The paddles 132 may be driven by a motor 110 or multiple motors under the control of a control system 120 which may include a control panel or other interface enabling an operator to input commands. It should also be appreciated that the paddles do not have to be wedge shaped. For example, the paddles could be flat-sided and welded to the shaft at a pitch, to assist in conveying the material. Also, the paddle heater may (or may not) be inclined by a few degrees to allow gravity to help with the movement of material through the machine.

In operation, asphalt may be fed into the paddle heater 100 via an inlet 101 which may include a hose, a shaft, an opening, and/or the like, capable of receiving material that is pumped in from a machine, shoveled in by hand, and/or the like. In some embodiments, the asphalt may include 100% reclaimed asphalt pavement plus any additional bitumen desired. The asphalt mixture that is fed through the inlet 101 may slowly move from a front end 133 of the trough 130 to a rear end 134 of the trough 130 where the material exits 102 out of an exit unit 150. As the asphalt mixture is heated, gas from the interior of the trough 130 may exit an exhaust 142 positioned at a top of the exterior 140 of the trough 130 or elsewhere.

Temperature sensors (not shown) may be disposed within the trough 130 and may be configured to sense a temperature of the asphalt within the trough 130. For example, the sensors may measure a temperature from within the asphalt and transmit a signal back to the control system 120 identifying the sensed temperature reading.

Figure 2:
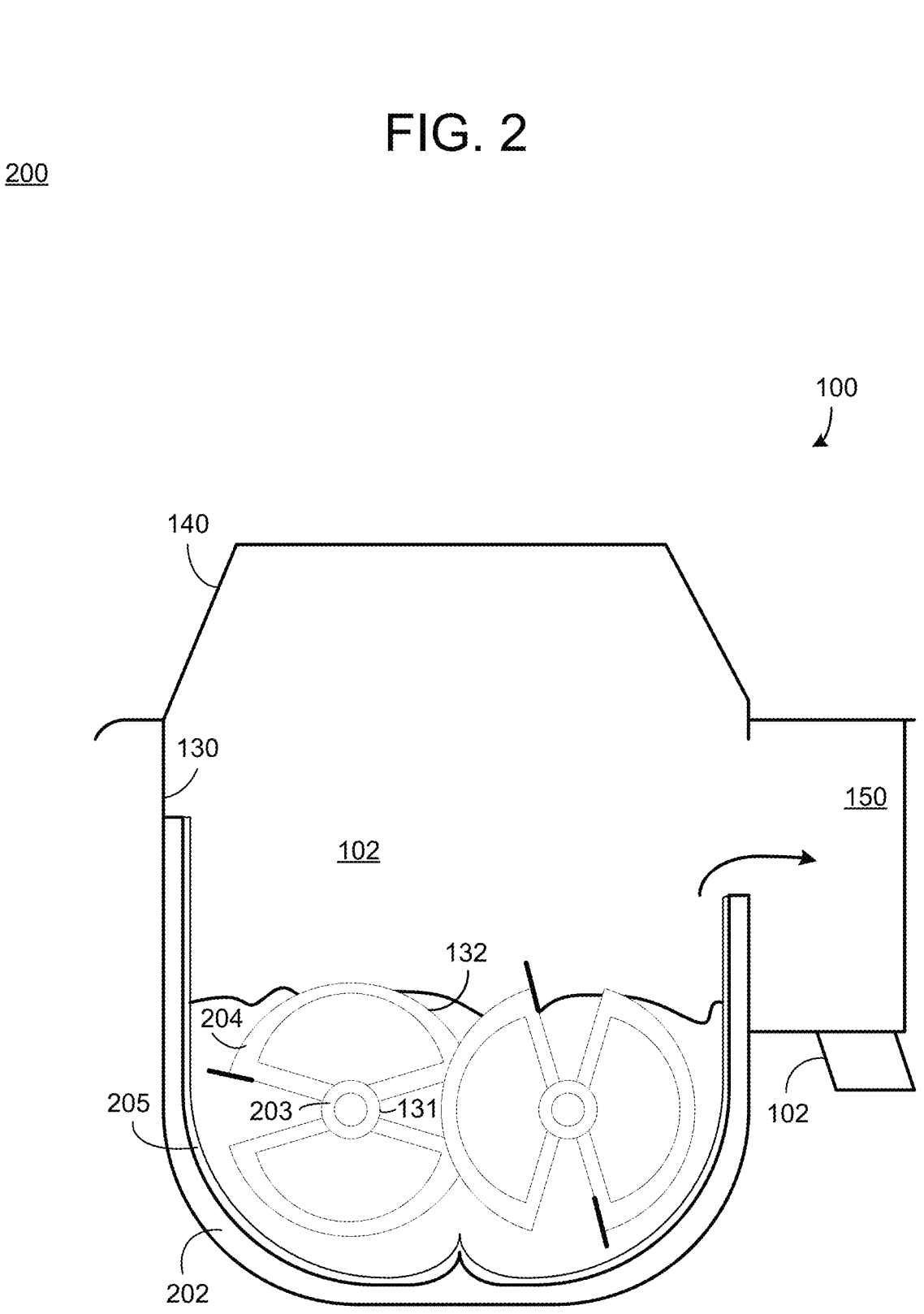
FIG. 2 is a diagram illustrating a cross-sectional view of the paddle heater shown in FIG. 1 including hollow channels for creating indirect heat in accordance with an example embodiment.

Referring to FIGS. 1 and 2, one or more of the trough 130, the shafts 131, and the paddles 132 may be formed with hollow cavities, channels, chambers, etc. A pump 160 (e.g., a centrifugal pump, etc.) may include a pipe or tube that connects to the hollow channels. Here, the pump 160 can pump heating fluid 170 (e.g., non-toxic oil, etc.) into the hollow channels to create an indirect heating system within the trough 130 of the paddle heater 100. A heater 180 (such as a natural gas heater) may be used to heat the heating fluid 170 prior to being pumped through the paddle heater 100.

In some embodiments, the channels within the paddle heater 100 may enable the heating fluid 170 to be recycled and returned back to the reservoir where it is held. By using heating fluid and applying indirect heat by contacting the asphalt mixture with one or more of a heated trough 130, heated shafts 131, and heated paddles 132, the paddle heater 100 can provide a more uniform heat source to the asphalt mixture in comparison to a traditional rotary drum heater which usually applies combustion heat at only one end of the heating chamber.

FIG. 2 illustrates a cross-sectional view 200 of the paddle heater 100 including hollow channels 202, 203, and 204, for creating indirect heat in accordance with an example embodiment. Referring to FIG. 2, the trough 130 may include a jacketed portion 202 which includes a hollowed-out area between an interior wall of the trough 130 (that contacts asphalt mixture) and an exterior wall of the trough 130 (which contacts the outside world). The hollowed-out area may have any desired channels or path shapes such as winding paths or the like. The pump 160 (shown in FIG. 1) may have a direct connection via a tube, pipe, etc., with the jacketed portion 202 of the trough 130 enabling heating fluid to be pumped through the jacked portion 202. The jacketed portion 202 includes a return tube/pipe that brings the heating fluid back to its original reservoir. In some embodiments, the interior surface of the trough 130 may be coated with a hard material 205 as done with the paddle to further prevent wear and tear.

As further shown in FIG. 2, additional hollowed-out portions 203 and 204 may be built into the shaft 131 and the paddle 132, respectively. These hollowed-out portions 203 and 204 (or channels) may also be connected to the pump 160 via a rotary joint or a tube/pipe, etc. enabling heating fluid to be pumped therethrough. Like the jacketed trough, the hollowed-out portions 203 and 204 has a return rotary joint or tube/pipe to bring the heating fluid back to its reservoir where it can be reused again. In some embodiments, a common rotary joint on the shaft end may be used to both supply and return the heating fluid back to its reservoir. The hollowed out portion 203 may be built underneath an exterior surface of the pipe 131 enabling indirect heat transfer to asphalt contacting the shaft 131. Likewise, the hollowed-out portion 204 may be built underneath an exterior surface of the paddles 132 enabling indirect heat transfer to asphalt contacting the paddles 132.

Figure 3:
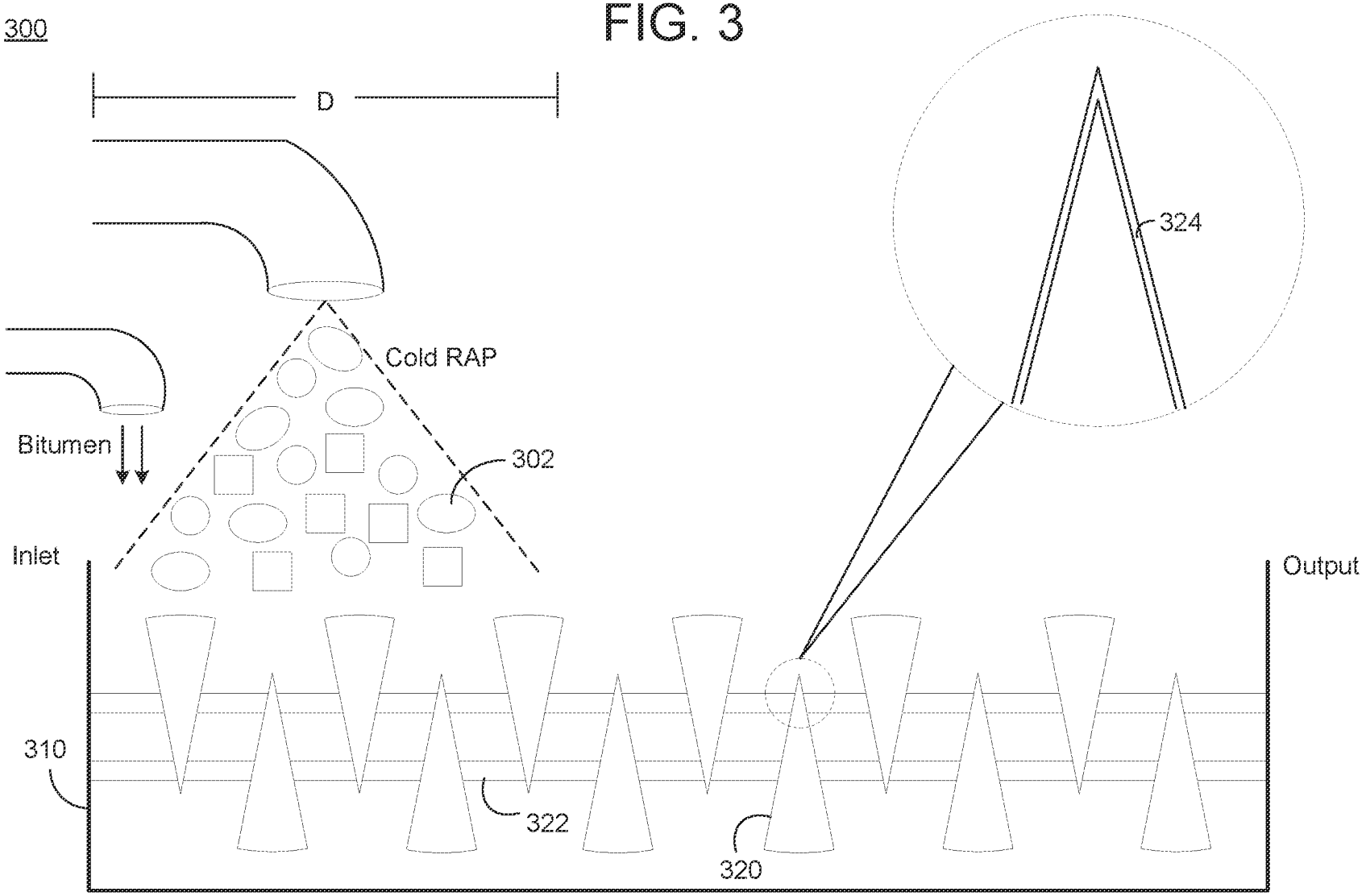
FIG. 3 is a diagram illustrating a process of adding RAP to the asphalt heating system in accordance with an example embodiment.

FIG. 3 is a diagram illustrating a process 300 of adding RAP 302 to the paddle heater in accordance with an example embodiment. Referring to FIG. 3, a trough 310 of the paddle heater is shown with an exterior cover removed. Cold RAP can be spread out/distributed over a predetermined distance D of the trough 310 to enable the cold RAP to heat up more easily. Here, the distance D may be dynamically defined. For example, the distance D may be about one third of a length of the trough 310. As another example, the distance D may be 25% length, 30% length, 35% length, 40% length, and the like. By spreading out the cold RAP over a larger surface area of the trough 310 and the agitators therein (paddles 320 and shafts 322), the cold RAP can be heated quicker. In addition, bitumen can be added. Here, the cold RAP is added at a one large feed zone, but it should be appreciated that the cold RAP may be added at a plurality of smaller feed zones. Also, the trough 310, the paddles 320, and the shafts 322 can be coated with a hardened surface 324 to prevent abrasion/damage to the equipment.

Figure 4:
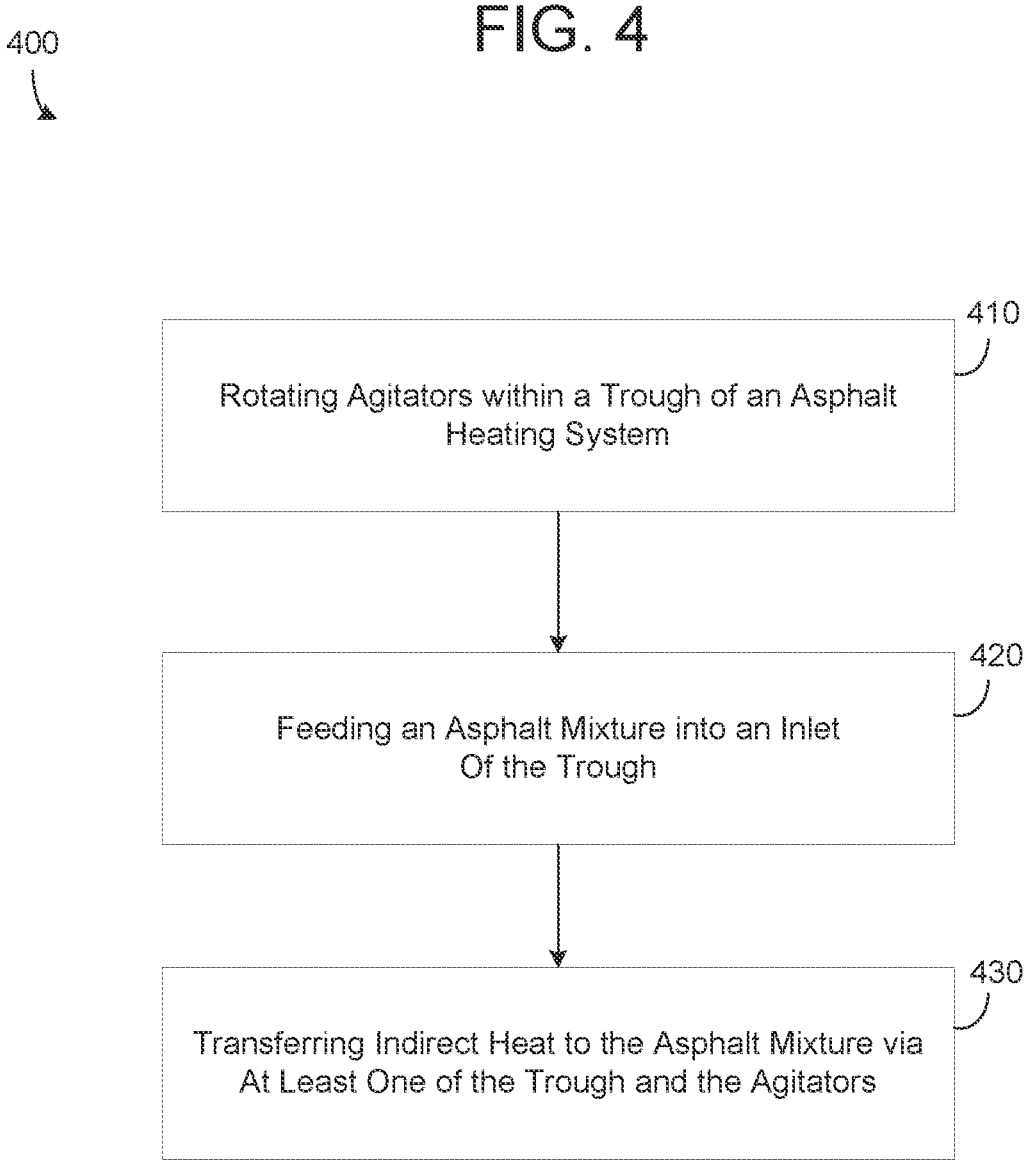
FIG. 4 is a diagram illustrating a method of indirectly heating asphalt in accordance with an example embodiment.

FIG. 4 illustrates a method 400 of indirectly heating asphalt in accordance with an example embodiment. For example, the method 400 may be performed by an asphalt heating system (e.g., paddle heater, etc.) that includes a trough, one or more agitators within the trough, a control system, and the like. Referring to the example of FIG. 4, in 410, the method may include rotating one or more agitators comprising paddles which are attached to one or more rotating shafts and which are housed within a trough of an asphalt heating system. For example, each agitator may include a shaft and a plurality of paddles attached and sticking outward from the shaft at approximately 90 degrees. The paddles rotate as the shaft rotates and the paddles rotate around the shafts. One or more of the paddles and the shaft may include hollow channels for receiving heated fluid.

In 420, the method may include feeding an asphalt mixture into an inlet of the trough where the one or more agitators are rotating causing the asphalt mixture to move towards an outlet of the trough. In some embodiments, the asphalt mixture may consist of reclaimed asphalt pavement (RAP) and bitumen. In other words, the asphalt mixture may not contain any virgin aggregate. In some embodiments, the asphalt may not contain bitumen either. For example, the paddles, the shaft of an agitator, and the interior of the trough may be coated (via welding, etc.) with a hardened material that prevents abrasion from the cold RAP.

In 430, the method may include transferring indirect heat to the asphalt mixture via at least one of the troughs and the one or more agitators to heat the asphalt mixture while it is within the trough. For example, the transferring may include pumping heating fluid via hollow channels of one or more of the troughs and the one or more agitators while the asphalt mixture is within the trough. As noted, the trough may be a jacketed trough with hollow channels, areas, tubes, spaces, etc., disposed between an exterior of the trough an interior (holding area of the asphalt) of the trough. By heating the channels in the jacketed trough, the trough can apply indirect heat to the asphalt held therein. As another example, the channels may be included underneath an exterior surface of the paddles and/or an exterior surface of the shaft of the one or more agitators. When the exterior surfaces of the shaft/paddles contact the asphalt mixture in the trough they can transfer indirect heat to the asphalt mixture based on the heating fluid being pumped through the channels thereof.

In some embodiments, the feeding may include initially spreading the asphalt mixture over a predetermined distance of the trough (e.g., approximately one third, one fourth, one half, etc.) of the trough during an initial heating process. For example, the asphalt mixture may include cold RAP even during an initial heating stage. By spreading the cold RAP over a wider surface of the agitators/trough the cold RAP will create less friction/abrasion on a surface of the agitators and the trough.

In some embodiments, the transferring may include pumping the heating fluid through the hollow channels of the jacketed trough. In some embodiments, the transferring may include pumping the heating fluid through hollow channels of a shaft and paddles of an agitator from among the one or more agitators. In some embodiments, the method may further include heating the thermal fluid prior to pumping the thermal fluid through the hollow channels. In some embodiments, the method may further include controlling a discharge product temperature of the asphalt mixture in the trough to remain between a predetermined temperature range. As a non-limiting example, the predetermined range may be between 300° F. and 400° F. during heating of the asphalt mixture, but embodiments are not limited thereto.

Figure 5:
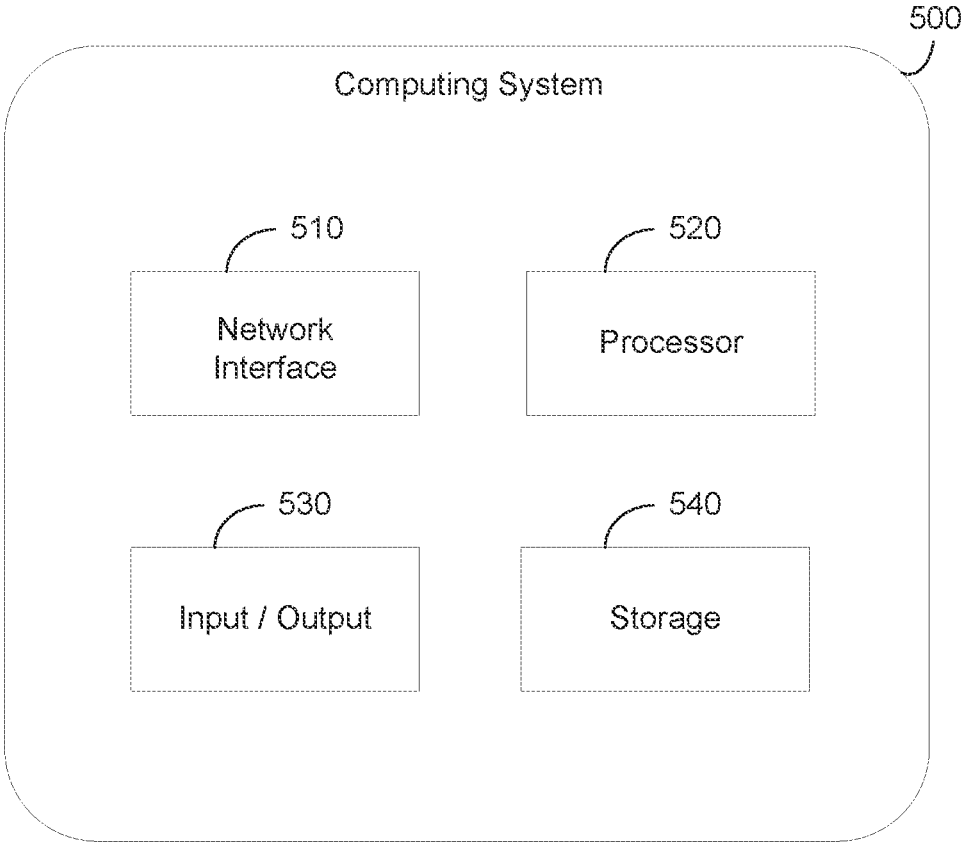
FIG. 5 is a diagram illustrating a computing system for use in the example embodiments described herein.

In some embodiments, the control system described herein or any other computer system usable with the example embodiments may include a computing system 500 as shown in the example of FIG. 5. For example, the above embodiments may be implemented in hardware, in a computer program executed by a processor, in firmware, or in a combination of the above. A computer program may be embodied on a computer readable medium, such as a storage medium or storage device. For example, a computer program may reside in random access memory ("RAM"), flash memory, read-only memory ("ROM"), erasable programmable read-only memory ("EPROM"), electrically erasable programmable read-only memory ("EEPROM"), registers, hard disk, a removable disk, a compact disk read-only memory ("CD-ROM"), or any other form of storage medium known in the art.

A storage medium may be coupled to the processor such that the processor may read information from, and write information to, the storage medium. In an alternative, the storage medium may be integral to the processor. The processor and the storage medium may reside in an application specific integrated circuit ("ASIC"). In an alternative, the processor and the storage medium may reside as discrete components. For example, FIG. 5 illustrates an example computing system 500 which may represent or be integrated in any of the above-described components, etc. FIG. 5 is not intended to suggest any limitation as to the scope of use or functionality of embodiments described herein. The computing system 500 is capable of being implemented and/or performing any of the functionality set forth hereinabove.

The computing system 500 may include a computer system/server, which is operational with numerous other general purpose or special purpose computing system environments or configurations. Examples of well-known computing systems, environments, and/or configurations that may be suitable for use as computing system 500 include, but are not limited to, personal computer systems, server computer systems, thin clients, thick clients, hand-held or laptop devices, tablets, smart phones, databases, multiprocessor systems, microprocessor-based systems, set top boxes, programmable consumer electronics, network PCs, minicomputer systems, mainframe computer systems, distributed cloud computing environments, databases, and the like, which may include any of the above systems or devices, and the like. According to various embodiments described herein, the computing system 500 may be a tokenization platform, server, CPU, or the like.

The computing system 500 may be described in the general context of computer system-executable instructions, such as program modules, being executed by a computer system. Generally, program modules may include routines, programs, objects, components, logic, data structures, and so on that perform particular tasks or implement particular abstract data types. The computing system 500 may be practiced in distributed cloud computing environments where tasks are performed by remote processing devices that are linked through a communications network. In a distributed cloud computing environment, program modules may be located in both local and remote computer system storage media including memory storage devices.

Referring to FIG. 5, the computing system 500 is shown in the form of a general-purpose computing device. The components of computing system 500 may include, but are not limited to, a network interface 510, one or more processors or processing units 520, an output 530 which may include a port, an interface, etc., or other hardware, for outputting a data signal to another device such as a display, a printer, etc., and a storage device 540 which may include a system memory, or the like. Although not shown, the computing system 500 may also include a system bus that couples various system components including system memory to the processor 520.

The storage 540 may include a variety of computer system readable media. Such media may be any available media that is accessible by computer system/server, and it may include both volatile and non-volatile media, removable and non-removable media. System memory, in one embodiment, implements the flow diagrams of the other figures. The system memory can include computer system readable media in the form of volatile memory, such as random access memory (RAM) and/or cache memory. As another example, storage device 540 can read and write to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to the bus by one or more data media interfaces. As will be further depicted and described below, storage device 540 may include at least one program product having a set (e.g., at least one) of program modules that are configured to carry out the functions of various embodiments of the application.

The above descriptions and illustrations of processes herein should not be considered to imply a fixed order for performing the process steps. Rather, the process steps may be performed in any order that is practicable, including simultaneous performance of at least some steps. Although the disclosure has been described regarding specific examples, it should be understood that various changes, substitutions, and alterations apparent to those skilled in the art can be made to the disclosed embodiments without departing from the spirit and scope of the disclosure as set forth in the appended claims.

What is claimed is:

1. An asphalt heating system comprising:

a control system;

a pump, to pump heating fluid from a reservoir;

a trough comprising an inlet to receive a feed of asphalt mixture and an outlet for exiting the asphalt mixture after heating; and one or more rotational agitators disposed in the trough and comprising paddles configured to rotate around one or more shafts to move the asphalt mixture from the inlet to the outlet, wherein at least one of the trough and the one or more rotational agitators comprise hollow channels connected to the pump to receive heating fluid from the pump, and the control system is configured to control the pump to pump heating fluid into the hollow channels when the asphalt mixture is included within the trough, the hollow channels connected to a return that returns the heating fluid to the reservoir.

2. The asphalt heating system of claim 1, wherein the trough comprises a jacketed trough with the hollow channels running therethrough, and the control system is configured to increase or decrease a temperature of the heating fluid that flows through the hollow channels of the jacketed trough.

3. The asphalt heating system of claim 1, wherein the one or more rotational agitators each comprise a shaft and a plurality of paddles attached to the shaft that rotate with the shaft.

4. The asphalt heating system of claim 3, wherein at least one of the shaft and the plurality of paddles include the hollow channels running therethrough, and the control system is configured to increase or decrease a temperature of the heating fluid that flows through the hollow channels of the shaft and the plurality of paddles.

5. The asphalt heating system of claim 1, wherein the trough and the one or more agitators comprise the hollow channels, and the control system is configured to increase or decrease a temperature of the heating fluid that flows through the hollow channels of the trough and the one or more agitators.

6. The asphalt heating system of claim 1, further comprising a heater configured to heat the heating fluid prior to the heating fluid entering the hollow channels.

7. The asphalt heating system of claim 3, wherein the plurality of paddles comprise wedge-shaped paddles with an additional hardening material welded on an outside thereof to prevent abrasion.

8. The asphalt heating system of claim 1, wherein the control system is configured to control a discharge product temperature of the asphalt mixture in the trough to cause the discharge product temperature to remain within a predetermined temperature range during heating of the asphalt mixture.

9. A method comprising:

rotating one or more agitators comprising paddles that are housed within a trough of an asphalt heating system;

feeding an asphalt mixture into an inlet of the trough where the one or more agitators are rotating causing the asphalt mixture to move towards an outlet of the trough wherein feeding comprises feeding the inlet of the trough with one or more of bitumen and reclaimed asphalt pavement (RAP) for a first predetermined period of time prior to feeding the inlet with virgin aggregate; and transferring indirect heat to the asphalt mixture via at least one of the trough and the one or more agitators to heat the asphalt mixture while it is within the trough, wherein transferring indirect heat comprises first heating a heating fluid and then pumping the heating fluid through hollow channels of a shaft and paddles of an agitator from among the one or more agitators.

10. The method of claim 9, wherein the transferring comprises pumping heating fluid via hollow channels of one or more of the trough and the one or more agitators while the asphalt mixture is within the trough.

11. The method of claim 9, wherein the feeding comprises spreading the asphalt mixture over approximately one third of the trough during an initial heating process.

12. The method of claim 9, wherein the trough comprises a jacketed trough with the hollow channels running therethrough, and the transferring comprises pumping the heating fluid through the hollow channels of the jacketed trough.

13. The method of claim 9, further comprising controlling an internal temperature of the asphalt mixture in the trough to remain within a predetermined range of temperatures during heating of the asphalt mixture.

* * * * *